US009169672B1

(12) United States Patent
Kislov

(10) Patent No.: US 9,169,672 B1
(45) Date of Patent: Oct. 27, 2015

(54) HURRICANE PROTECTIVE SYSTEM

(76) Inventor: Nikolai Kislov, Tampa, FL (US)

( * ) Notice: Subject to any disclaimer, the term of this patent is extended or adjusted under 35 U.S.C. 154(b) by 0 days.

(21) Appl. No.: 13/435,169

(22) Filed: Mar. 30, 2012

Related U.S. Application Data

(63) Continuation-in-part of application No. 12/657,308, filed on Jan. 19, 2010, now abandoned.

(51) Int. Cl.

| | |
|---|---|
| ***E06B 5/00*** | (2006.01) |
| ***E06B 3/30*** | (2006.01) |
| ***E05B 65/10*** | (2006.01) |
| ***E06B 9/02*** | (2006.01) |
| *E06B 9/00* | (2006.01) |

(52) U.S. Cl.
CPC ..... *E05B 65/1033* (2013.01); *E06B 9/02* (2013.01); *E06B 2009/005* (2013.01)

(58) Field of Classification Search
CPC .. E05B 65/1033; E06B 9/02; E06B 2009/005
See application file for complete search history.

(56) References Cited

U.S. PATENT DOCUMENTS

| | | | | | |
|---|---|---|---|---|---|
| 4,685,261 | A * | 8/1987 | Seaquist | 52/202 |
| 5,347,775 | A * | 9/1994 | Santos | 52/202 |
| 5,487,244 | A * | 1/1996 | Hill | 52/202 |
| 5,540,018 | A * | 7/1996 | Biggers | 52/202 |
| 5,596,849 | A * | 1/1997 | Hill | 52/202 |
| 5,941,031 | A * | 8/1999 | Fullwood | 52/202 |
| 5,996,292 | A * | 12/1999 | Hill et al. | 52/202 |
| 6,189,264 | B1 * | 2/2001 | DiVeroli | 49/57 |
| 6,286,579 | B1 * | 9/2001 | Gottschalk | 160/264 |
| 6,941,999 | B2 * | 9/2005 | Paterni | 160/184 |
| 6,974,622 | B2 * | 12/2005 | Wade | 428/182 |
| 7,438,336 | B1 * | 10/2008 | Wolf et al. | 292/341.17 |
| 7,526,896 | B1 * | 5/2009 | Lohmeyer et al. | 52/202 |
| 7,805,898 | B1 * | 10/2010 | Everitt | 52/202 |
| 7,823,342 | B1 * | 11/2010 | Van Horn Steel et al. | 52/127.8 |
| 7,963,313 | B1 * | 6/2011 | Bennett et al. | 160/368.1 |
| 8,001,735 | B2 * | 8/2011 | Fisher | 52/202 |
| 8,074,408 | B1 * | 12/2011 | Motosko et al. | 52/202 |
| 8,196,363 | B2 * | 6/2012 | Hay et al. | 52/204.62 |
| 8,528,279 | B1 * | 9/2013 | Greene, Jr. | 52/202 |
| 8,590,225 | B1 * | 11/2013 | Steel et al. | 52/202 |
| 2004/0250477 | A1 * | 12/2004 | Butcher | 52/3 |
| 2005/0072533 | A1 * | 4/2005 | Vincent | 160/133 |
| 2006/0179737 | A1 * | 8/2006 | Trundle | 52/202 |
| 2006/0230695 | A1 * | 10/2006 | Swergold | 52/202 |
| 2007/0000193 | A1 * | 1/2007 | Beaupre et al. | 52/202 |
| 2007/0101666 | A1 * | 5/2007 | Munch | 52/202 |
| 2007/0107327 | A1 * | 5/2007 | Warner | 52/202 |
| 2007/0107328 | A1 * | 5/2007 | Munch | 52/202 |
| 2007/0113494 | A1 * | 5/2007 | Kim et al. | 52/202 |
| 2008/0169070 | A1 * | 7/2008 | Mullet et al. | 160/369 |
| 2009/0049772 | A1 * | 2/2009 | Milliken et al. | 52/202 |
| 2009/0288352 | A1 * | 11/2009 | Wenrick et al. | 52/202 |

* cited by examiner

*Primary Examiner* — Katherine Mitchell
*Assistant Examiner* — Justin Rephann

(57) ABSTRACT

A building opening provides both a burglar protection and egress from the building during emergency such as fire. The system utilizes a protective cover having securable apertures for engaging and releasable securing a protective panel to the outer wall over the building by applying clamp fasteners configured for locking and releasing the securable aperture from the inside of the building. Also included is the method of utilization.

4 Claims, 14 Drawing Sheets

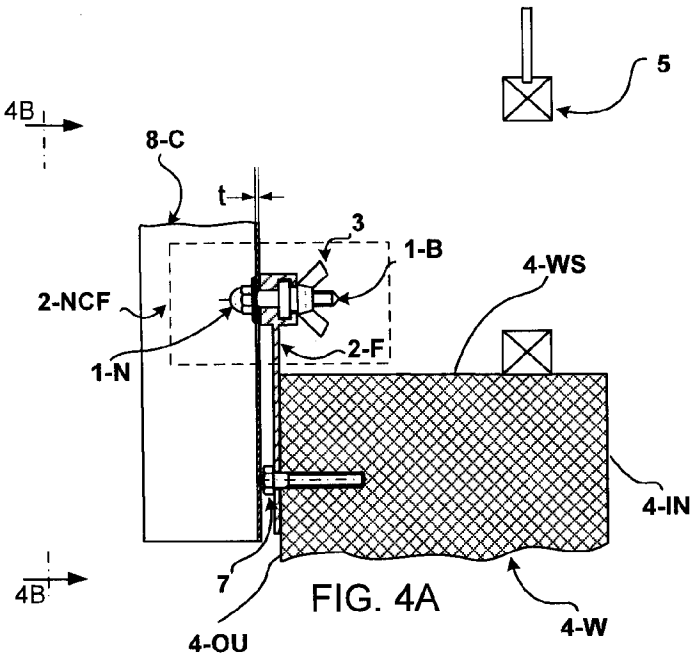
FIG. 4A
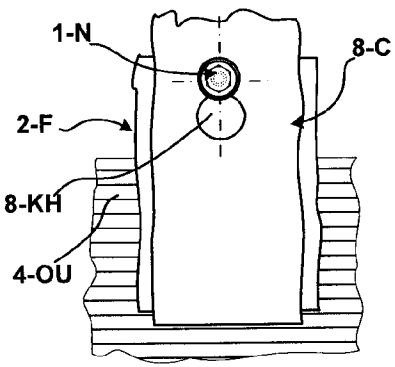
FIG. 4B
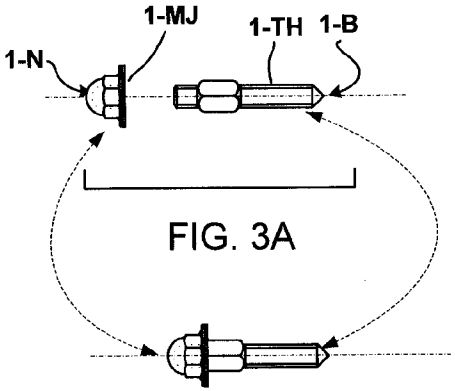
FIG. 3A
FIG. 3B

HURRICANE PROTECTIVE SYSTEM

RELATED APPLICATION

The present invention is a continuation-in-part patent application of pending U.S. patent application Ser. No. 12/657,308 filed Jan. 19, 2010, the subject matter of which is incorporated herein by reference.

BACKGROUND OF THE INVENTION

1. Field of the Invention

The present invention relates generally to a storm and guard shutter method and assembly for building external openings and, more particularly, to a window and door shutter for both guarding as a security barrier to deter an intruder from entering the building and storm shielding as a storm barrier to protect the window and door from strong winds and wind-borne debris, which are accompanied by capability to be removed from the opening by a person inside of the building in the case of emergency.

2. Description of the Prior Art

Both window and door guards are conventionally used to prevent unauthorized entry through window and door openings. Storm shutters are needed to protect a building from wind damage by flying debris during hurricanes or cyclones. Known prior art includes U.S. Pat. Nos. 6,205,713 and 6,293,059 which are made up of heavy plywood panels; U.S. Pat. Nos. 5,487,244, 5,596,849, 5,768,833, 5,996,292, and 6,209,263 which are made up of corrugated aluminum or still panels; U.S. Pat. Nos. 5,457,921 and 6,470,639 which are made up of corrugated and solid translucent plastic panels, respectively. The above mentioned installed from outside window and door protective panels, as well as a variety of others not mentioned here and hurricane shutters, have a number of drawbacks. Among them, the most important is that in the event of fire or other emergency, it is impossible for someone inside of the building to leave the building through the permanently guarded or fastened from outside window or door.

U.S. Pat. No. 4,562,666 to Young, III discloses a burglar guard for windows and doors, which is constructed of unbreakable, bullet-resistant, transparent sheet material, such as polycarbonate or Lexan plastic which is installed on the interior of the building window openings. Such cover can be quickly removed from inside in the case of emergency, however, it does not protect against breakage of windows by both vandals and hurricane/tornado wind and debris.

Publication No. US 2006/0283131 and U.S. Pat. No. 7,438,336 to Wolf and Clark disclose a hurricane shutter escape mechanism for allowing removal of a conventional hurricane shutter from a window or door of a structure in the event of emergency. However it does not protect against unauthorized opening from outside of the building.

Relevant to the prior art are also U.S. Pat. No. 2,878,536 which discloses corrugated overlapping shutters having brackets fastened to the building. U.S. Pat. No. 5,596,849 to Hill disclosures a system including panels and the joint structure that includes the utilization of an angle frame at the base, and an overlapping receiver as a header. The lower portion overlap has a keyhole slot that is manually threaded on the bottom lock screw in place. U.S. Pat. No. 2,867,011 to Becjer discloses a shutter structure using a fastener comprising a thumb screw and wing nut for attaching storm shutters together. U.S. Pat. No. 2,719,750 to Orr discloses a keyhole slot for attachment. U.S. Pub. US 2006/0010792 A1 references employment of a sill bracket comprised of a recessed bolt head track body with a vertical track aperture. After inserting the head in a bolt and positioning a hurricane shutter panel through its bottom hole and the bolt, the panel is secured to the sill bracket by a wing nut.

None of the subject patents discloses a panel lock and release mechanism for hurricane shutters which provides substantial security against unauthorized removing from outside.

Recently submitted by the applicant, another non-provisional patent application describes designs capable of providing both an easy escape mechanism in the case of emergency and an enhanced security of the building against an unwanted intrusion (Pub. Nom.). However, it does not disclose a panel fastening construction, which allows quick installation and dismounting shutter panels to the escape mechanism.

What is needed is protective shutter system for a window and door, which allows easy mounting and dismounting shutter panels and has capability to be unlocked in the event of an emergency, but when it is locked, difficult to remove from outside of the building, thus providing a high degree of security.

SUMMARY OF THE INVENTION

The general purpose of the present invention, which will be described subsequently in more detail, is to provide a new protective shutter system that can be secured and released from the inside of a building, which is cost effective and uses conventionally available construction and manufacturing materials without significant investment for production of non-standard parts and equipment.

Moreover, such system can be used for easy retrofitting hurricane protection for buildings that have been equipped with older unsophisticated systems.

In addition, the protective shutter system of the present invention is intended to be reliable and easy to install and use.

An additional object is to provide a protective shutter system and method which can be activated easily and quickly by both people within the building and by emergency personnel outside of the building in the case of incapacity of the people inside of the building.

Still a further object is to provide a protective shutter system emergency with escape mechanism for a security of a building which is normally in a locked position and also maintain a storm protective utility protecting window, door, or other openings of a building which can be activated easily and quickly by people from inside the building.

The object is also to prevent entry through the window, door, or another opening to reduce burglaries when the building is empty or unoccupied during an evacuation period and a post-evacuation period when people have returned back home but the area is still at the risk of a criminal entry.

Yet another object of this invention is to provide a relatively inexpensive method and system for protecting openings, which can be installed by one person located inside of the building, without the necessity to utilize ladders or other equipment to reach openings that are located above the ground level of the building.

Further aspects and advantages of this invention will be evident from the following detailed description, which proceeds with reference to the accompanying drawings.

BRIEF DESCRIPTION OF THE DRAWINGS

The present invention can be described by reference to the following figures.

FIG. 3A is an exploded side view of a hex cap nut (1-N) and a square neck bolt (1-B) assembly, FIG. 3B is a side view a hex cap nut (1-N) and a square neck bolt (1-B) assembly, which, in assembly, functions as a step bolt (1).

FIG. 4A is a cross-sectional view of the nut driven clamp fastener (2-NCF) in a combination with a corrugated panel (8-C) mounted over the opening sill (4-WS), when a hex cap nut (1-N) and a square neck bolt (1-B) assembly is used in replacement of the step bolt (1), which is shown in a locked position.

FIG. 4B shows View 4B of FIG. 4C.

The same reference numerals refer to the same parts throughout the various Figures.

DESCRIPTION OF THE PREFERRED EMBODIMENTS

In the following description of the preferred embodiments, reference is made to accompanying drawings that form a part hereof, and in which is shown by way of illustration a specific embodiment in which the invention may be practiced. It is to be understood that other embodiments may be utilized and structural changes may be made without departing from the scope of the present invention.

Note: Reference numbers are parenthetically cited by the claims.

LIST OF REFERENCE NUMBERS

Figure 5A:
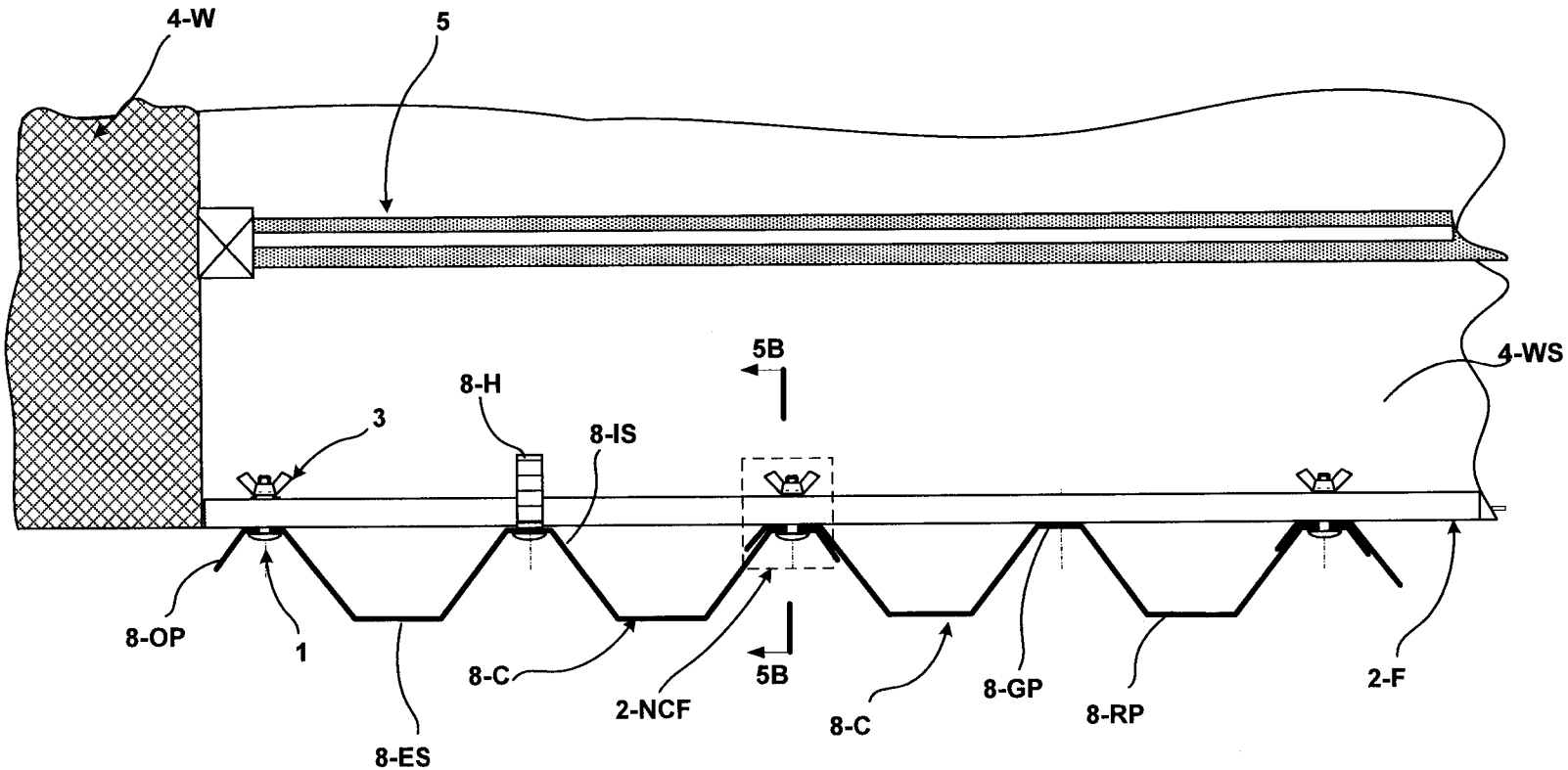
FIG. 5A is a top view of a part of the shutter panel assembly (8), with two corrugated panels (8-C) mounted over the building opening (4-O).
Figures 11A, 11B, 11C:
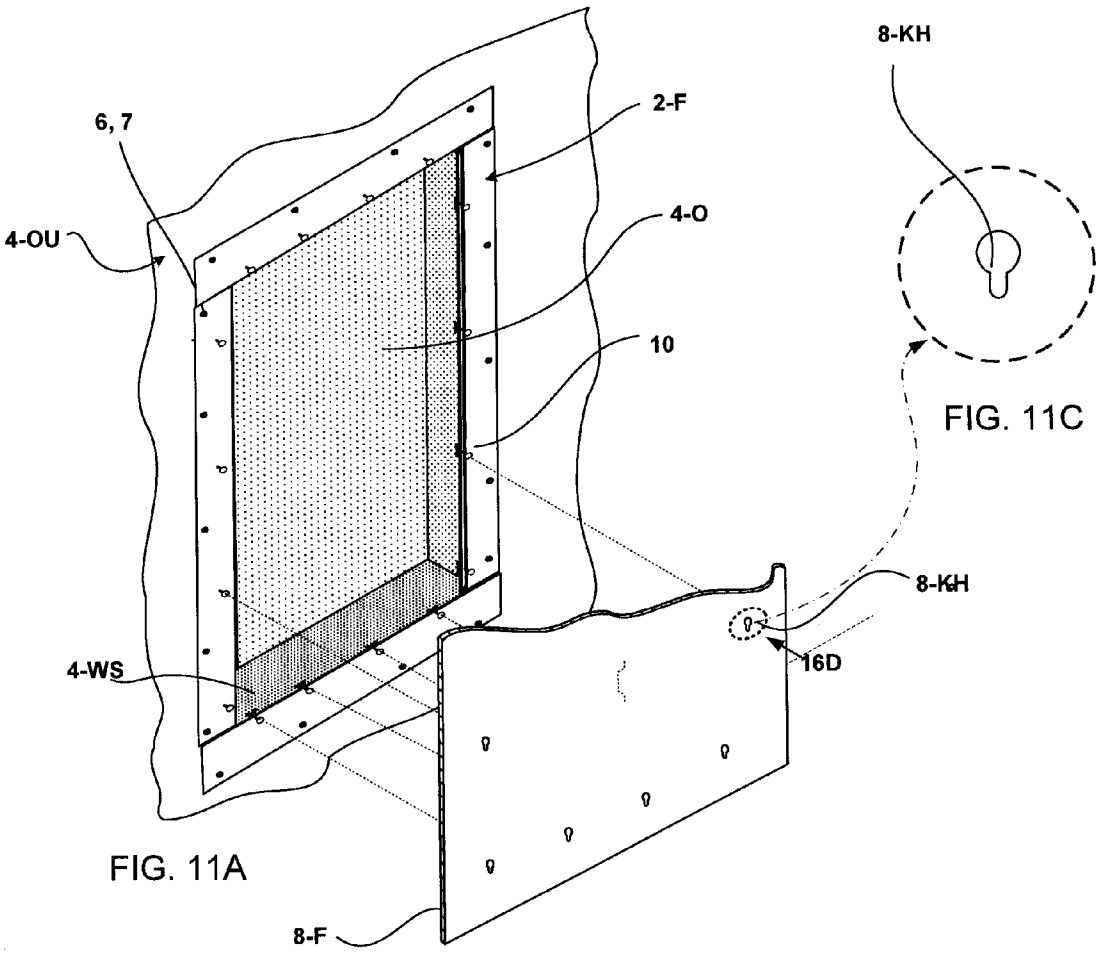
FIG. 11A is a perspective view of the window opening which is equipped with four elongated flat "F" tracks (2-F) holding longwise spaced nut driven clamp fasteners (2-NCF).
FIG. 11B is a perspective view of a flat shutter panel (8-F) applied to the embodiment of FIG. 11A, with securable means in the form of a keyhole (8-KH); each keyhole is aligned by such way that the keyhole slot (8-KHS) is down and the keyhole opening (8-KHO) is up.
FIG. 11C is an enlarged view of a keyhole (8-KH) in a flat panel (8-F) for fastening.
Figure 12A:
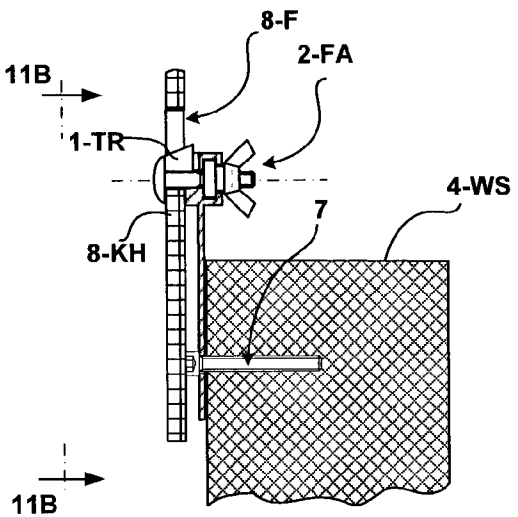
FIG. 12A is a cross-sectional view of a single nut driven clamp fastener (2-NCF) in the assembly with a flat panel (8-F) mounted over the opening sill (4-WS), which is shown in a locked position.
Figure 12B:
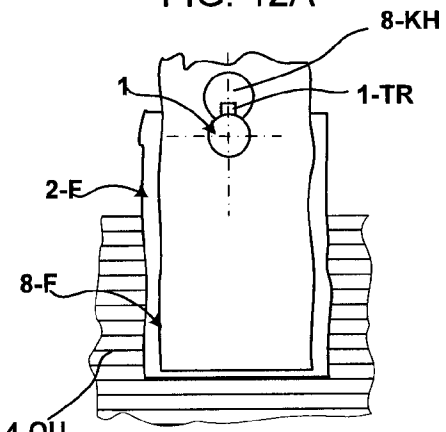
FIG. 12B shows View 12B of FIG. 12A.
Figure 12C:
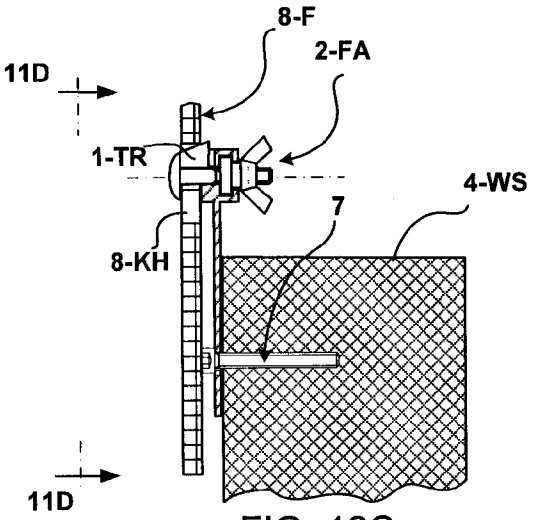
FIG. 12C is a cross-sectional view of a single nut driven clamp fastener (2-NCF) in the assembly with a flat panel (8-F) mounted over the opening sill (4-WS), which is shown in a ready to be removed position.
Figure 12D:
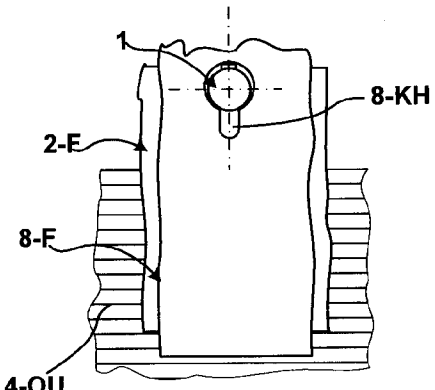
FIG. 12D shows View 12D of FIG. 12C.

1 step bolt with a square neck for a nut driven clamp fastener (movable jaw member)
1-KE flange bolt with a key end for a bolt driven clamp fastener (movable jaw member)
1-KB key end bolt head for a flange bolt with a key end
1-KS key end socket head for a flange bolt with a key end
1-S serrated flange step bolt with a square neck for a nut driven clamp fastener (movable jaw member)
1-MJ movable jaw inward face
1-SN sliding neck of the step bolt (1), shank
1-RN round neck of the step bolt 1
1-SS locking serrations on the face of the flange (movable jaw inward face)
1-N hex cap nut with a shoulder for a nut driven clamp fastener assembly
1-B square-neck two-side threaded bolt for a nut driven clamp fastener assembly
1-TH thread for engagement with manipulator (3) (engaging with 3-TH)
1-SH step-bolt head a nut driven fastener assembly
1-FH flange bolt head for a bolt driven fastener assembly
1-TS thread for engagement with threaded aperture for a bolt driven fastener assembly
1-T step bolt with a stuck preventive ledge under the bolt head
1-TR preventive nip ledge
2-NCF nut driven clamp fastener assembly
2-BCF bolt driven clamp fastener assembly
2-IW clamp fastener's side facing inward of the opening
2-OW clamp fastener's side facing outward of the opening
2-A angled "F" track for assembly of the nut driven clamp fastener (fixed jaw member)
2-F flat "F" track for assembly of the nut driven clamp fastener (fixed jaw member)
2-RB rectangular bar for assembly of bolt driven clamp fastener (fixed jaw member)
2-TS thread for engagement with threaded flange bolt for the bolt driven clamp fastener
2-FJ fixed jaw outward face of the fixed jaw member
2-EE engaging element of the fixed jaw member
2-U U-shaped "F" track for assembly of the nut driven clamp fastener (fixed jaw member)
2-MP mounting part of fixed jaw member
2-CP clamping part for fixed jaw member
2-BA handle for manipulating a shutter panel
2-SH square hole of sliding aperture
2-FS "F" track slot/channel (engaging holder)
2-OC open channel of "F" track
2-MH aperture for mounting in the mounting part of the fixed jaw member
2-TR slit for sliding preventive rectangular ledge 1-TR of the step bolt with a stuck preventive ledge under the bolt head
2-TB a stuck preventive ledge
3 manipulator for a nut driven clamp fastener (manipulating member)
3-EC engaging cylinder for insertion into "F" channel for a nut driven clamp fastener
3-NC neck cylinder for manipulator (3) in a nut driven clamp fastener
3-WN a wing nut handler for a nut driven clamp fastener thread for engagement with step-bolt (movable jaw member)
3-TH engaging pass
3-EP handle for engagement with key end socket head for a
3-KE spin clamp fastener (T handle Allen key)
4-W building wall
4-OU outer wall surface of the building structure 4-W
4-IN inner wall surface of the building structure 4-W
4-WS window and door sill
4-O building opening
5 existing glazing in open position for access to the shutter assembly
6 anchor insert
7 mounting bolt
8 shutter panel assembly (shield member)
8-H handle for the outer panel
8-C corrugated shutter panel
8-OP outer panel
8-GP grove segment of corrugated shutter panel
8-RP ridge segment of corrugated shutter panel
8-F flat shutter panel (one panel)
8-KH key hole (securable means in a shutter panel)
8-KHO key hole opening
8-KHS key hole slot
8-IS interior panel surface
8-ES exterior panel surface
8-SO area of slidable overlapping of two corrugated panels
11 top angled mount with U-header FIG. 5A, 11B, corrugated and flat panels, FIGS. 1A, 1G, 8A-C and 9 disclose a hurricane protective system for a building opening that can be secured and released from the inside of a building. Such system comprises a shield member (8), (8-F) for fitting over a building opening (4-O). The shield member has an interior surface (8-IS) and an exterior (8-ES) surface. The shield member is accessible for securing and removing from the inside of the building. The shield member includes at least one securable means (8-KH) for engaging with a clamp fastener (2-NCF or 2-BCF) positioned accordingly and configured for locking and releasing the securable means from the inside of the building to furnish both holding the shield member (8) (8-F) in place and removing the shield member (8), (8-F) from the building opening (4-O).

The hurricane protective system for a building opening can be secured and released from the inside of a building. The clamp fastener (2-NCF or 2-BCF) further comprises a fixed jaw member (2-A, 2-F, 2-U, 2-RB) including joined together a mounting part (2-MP) for mounting to the building and a clamping part (2-CP) comprising a joint of a fixed jaw (2-FJ) on the side facing outward of the building for engaging with the securable means (8-KH) of the shield member (8), (8-F) and, in a holding position, being in a contact with the shield member (8), (8-F) side facing inward (8-IS) of the opening (4-O) and an engaging element (2-EE) for functional engagement with at least one movable jaw member (1, 1-FW, 1-KE, 1-S) coupled with a manipulating member (3, 3-WH), with the clamping part (2-CP) and the mounting part (2-MP) being positioned apart one from the other so that the mounting part (2-MP) is placed within the border surrounding the opening (4-O). The clamping part (2-CP) is projected from the border inward of the building opening (4-O) and is accessible from the inside of the building.

The movable jaw member (1, 1-FW, 1-KE, 1-S) comprises a joint of a movable jaw (1-MJ) on the side facing inward of the building for engaging with the securable means (8-KH) of the shield member (8), (8-F) and, in a holding position, being in a contact with the shield member (8), (8-F) side facing outward (8-ES) of the opening (4-O) and an engaging link (1-EL) for functional engagement with both the fixed jaw member (2-A, 2-F, 2-U, 2-RB) and manipulating member (3, 3-WH), so that in a clamped position the shield member is squeezed between fixed jaw outward (2-FJ) and movable jaw inward (1-MJ, 1-SS) sides. The manipulating member (3, 3-WH, 3-KE) is positioned on the side of the clamp fastener facing inward (2-IW) of the opening and located in the area accessible from the inside of the building. The manipulating member comprises a joint of a handle (3-WN, 3-KE) configured for accepting manually applied movement and an engaging pass (3-EP) for a functional engagement of the manipulating member (3, 3-WH, 3-KE) with both the fixed jaw member (2-A, 2-F, 2-U, 2-RB) and the movable jaw member (1, 1-FW, 1-KE, 1-S) for converting the movement for generating inward pressure between the fixed (2-FJ) and the movable jaws (1-MJ, 1-SS) for clamping.

The shield member comprises a shutter panel assembly (8), (8-F) consisting of a plurality of elongated corrugated panels (8-C) aligned along one of two of the building opening (4-O) border directions extending from one border of the building opening toward the opposite border, covering the building opening completely. Each of the panels is arranged in a slidable elongated overlapping (8-SO) at least a portion of another panel adjacent thereto, forming at least one outer panel (8-OP) relative to the building. The outer panel retaining the securable means (8-KH) is in the form of keyhole slots, with a major axis running parallel to the direction of the corrugations, for engaging with the clamp fastener (2-VCF or 2-SCF).

The outer panel is secured as the last and released as the first from the inside of the building, and, when removed, provides an access for further release of the adjacent panel.

Figure 5B:
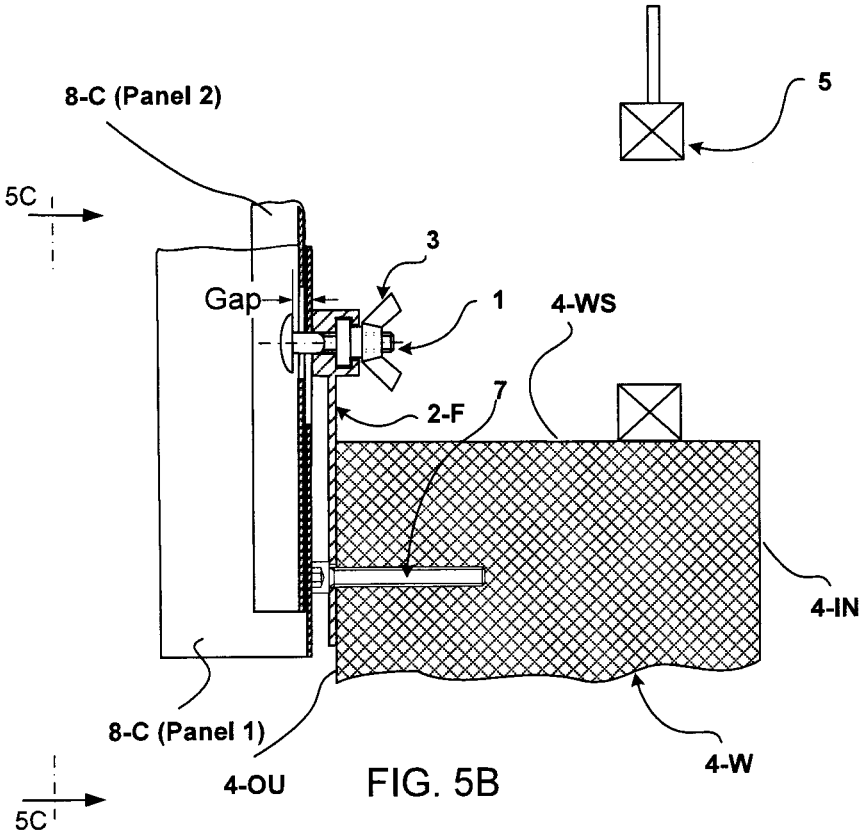
FIG. 5B is 5B cross-sectional view in FIG. 5A of the nut driven clamp fastener (2-NCF) in a combination with a corrugated panel (8-C) mounted over the opening sill (4-WS), which are shown in an unlocked position with Panel 2 in the ready to be removed position (up) and Panel 1 in the down position.
Figure 5C:
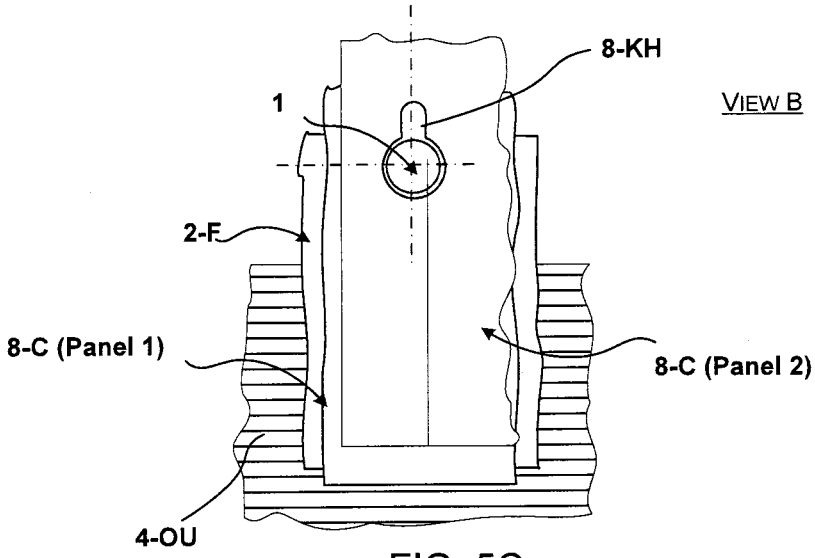
FIG. 5C shows View 5C of FIG. 5B.
Figure 6A:
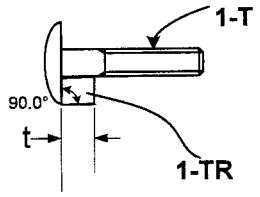
FIG. 6A is a side view of a step bolt (1-T) having a rectangular ledge under the bolt head, which is for prevention both step bolt rotation and an accidental stuck of a shutter panel at the moment of its removal.
Figure 6B:
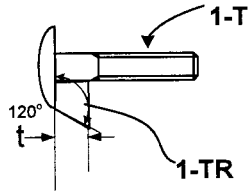
FIG. 6B is a side view of a step bolt (1-T) having a 120° ledge under the bolt head.
Figure 6C:
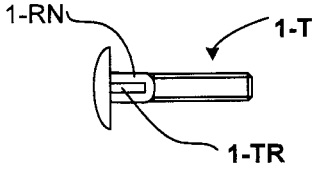
FIG. 6C is a bottom view of the step bolt (1-T) shown in FIG. 6A.
Figure 6D:
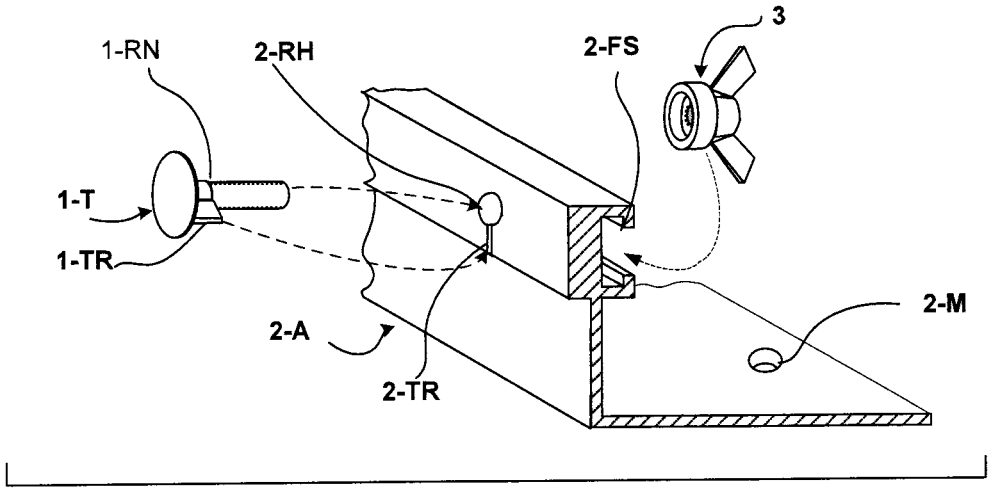
FIG. 6D is an exploded perspective view of a nut driven clamp fastener (2-NCF) for a hurricane protective system, which is equipped with the present invention step bolt (1-T) with a rectangular ledge (1-TR) under the bolt head shown in FIG. 6A.
Figure 6G:
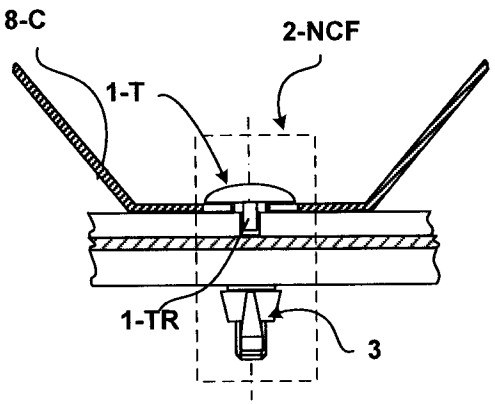
FIG. 6G is 6G bottom view in FIG. 6A.
Figure 6F:
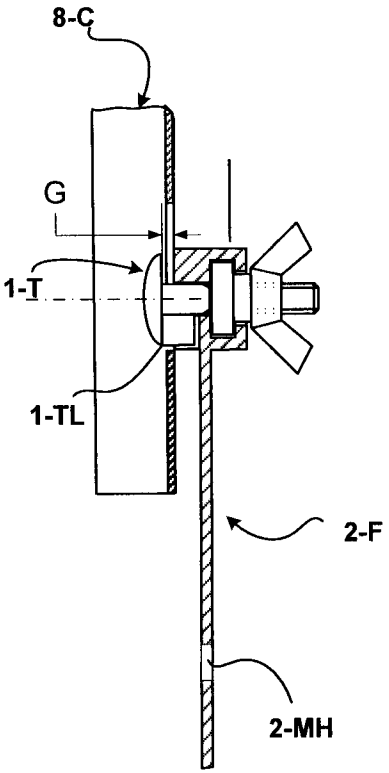
FIG. 6F is a cross-sectional view of a nut driven clamp fastener (2-NCF) with the present invention step bolt (1-T) of FIG. 6A in a combination with a corrugated panel (8-C), which is in the open position allowing to remove the panel (8-C).
Figure 6E:
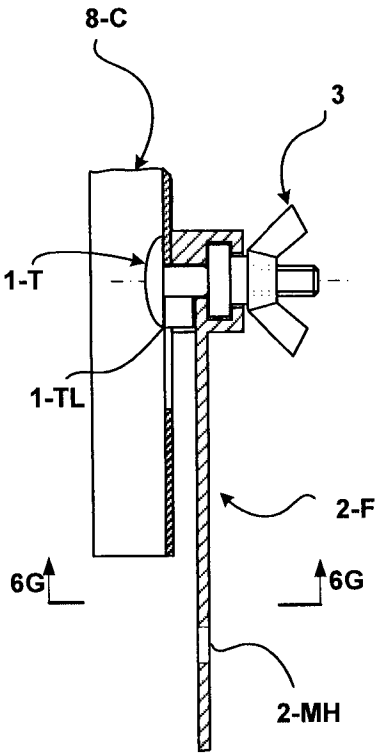
FIG. 6E is a cross-sectional view of a nut driven clamp fastener (2-NCF) with the present invention step bolt (1-T) of FIG. 6A in a combination with a corrugated panel (8-C), which is shown in a completely closed locked position.

With respect to FIG. 5, the hurricane protective system can be secured and released from the inside of a building of and further comprises the shutter panel assembly (8) including a handle (2-BA) attached from a side facing inward of the opening (8-IS) to at least one panel (8-C) of the assembly, which is the outer panel (8-OP) relative to the building, to facilitate manipulation of the shutter panel when completing assembling and when beginning disassembling from the inside of the building.

With reference to FIGS. 1 and 2, the hurricane protective system for a building opening that can be secured and released from the inside of the building of wherein the clamp fastener is a nut driven clamp fastener. In addition, the manipulating member (3) comprises, joined together and axially spaced, a nut, preferably ring-wing nut (3-WN) for securing without the need for a tool. A first holed cylinder, the engaging cylinder (3-EC), has an inner and an outer diameter and length (3-EA), which are axially joined by a second holed cylinder. The neck cylinder (3-NC) has an inner and an outer diameter and length, with the inner diameter of both cylinders sufficient for penetration by a rod for engaging with the thread of the nut and the outer diameter of the first cylinder larger than thereof of the second cylinder.

The movable jaw member (1, 1-S) is selected from a group of bolts having preferably an enlarged domed head (1-SH) and a non-round shank under the head, more preferably from a group of step-bolts, and still more preferably from a group of step-bolts having a square shank (1-SN). The movable jaw (1-MJ) is the under head part of the head. The sliding neck (1-SN) is the square shank under the head. The movable jaw connector is a threaded part of the step-bolt (1-TH), which has the same size of the thread that the size of the thread of the nut (3-TH) of the manipulating member (3).

The securable means of the shield member (8) is an aperture (8-KH) in the shutter panel (8-C), which is selected from a group consisting of holes, preferably a keyhole slot (8-KH) having the round portion of the keyhole slot having size sufficient to loosely pass through the opening (8-KHO) of the head of the step-bolt. The width of the keyhole slot (8-KHS) is sufficient for loosely sliding the shank of the step-bolt along the slot. All the keyhole slots (8-KHS) in the panel has a major axis running generally parallel to the direction of extending from one border of the building opening toward the opposite the border.

The fixed jaw member (2-A, 2-F, 2-U) is selected from a group of "F" tracks having a "F" channel extended along of the "F" track and located in the clamping part (2-CP). The "F" channel (2-FS) has a crossed inner width and length and is connected with a narrower outlet open channel (2-OC) having a crossed width and length, which is symmetrical relatively to the wider "F" channel. The mounting part is located across the track on the side opposite to the "F" channel. The "F" channel of the "F" track is located on the side facing inward the opening (2-IW). The fixed jaw (2-FJ) is on the side facing outward of the building opening. The "F" track channel (2-FS) accompanied by the narrower outlet channel (2-OC) has crossed an inner width and length sufficient for inserting and sliding the engaging (3-EC) and neck (3-NC) cylinders of the manipulating member (3). The slidable aperture (2-SH) is protruded symmetrically in relation to both the "F" track (2-FS) and outlet (2-OC) channels and connects "F" channel with the side facing outward of the building opening (2-OW), the fixed jaw side, the slide aperture (2-SH) is frictionally coupled with the square shank (1-SN) of the step-bolt (1).

When assembling the progressive clamp fastener (2-PCF), providing slidable insertion and rotational movement of the engaging cylinder (3-EC) of the manipulating member (3) in the "F" channel (2-FS) and axial threaded engagement of the threaded part of the manipulating member (3), which is inserted into the slidable aperture (2-SH) from the outward (2-OW) to the inward (2-IW) side of the engaging element (2-EE), with the threaded part (1-SH) of the step-bolt. This provides conversion of accepted by the handle (3-WN) manually applied rotational movement into the progressive movement of the movable jaw (1-MJ) for generating the clamping force applied to the panel (8-C, 8-F), when the panel (8-C, 8-F) is positioned in the gap between the movable (1-MJ) and fixed (2-FJ) jaws. This results in holding the panel (8-C, 8-F) in the fastened position.

Figure 1D:
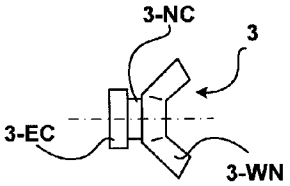
FIG. 1D is a side view of the manipulator (3).
Figure 1E:
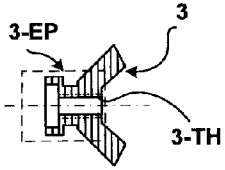
FIG. 1E is a cross-sectional view of the manipulator (3).
Figure 1F:
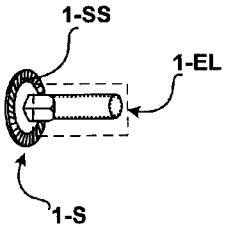
FIG. 1F is a perspective view serrated flange step bolt (1-S).
Figure 1A:
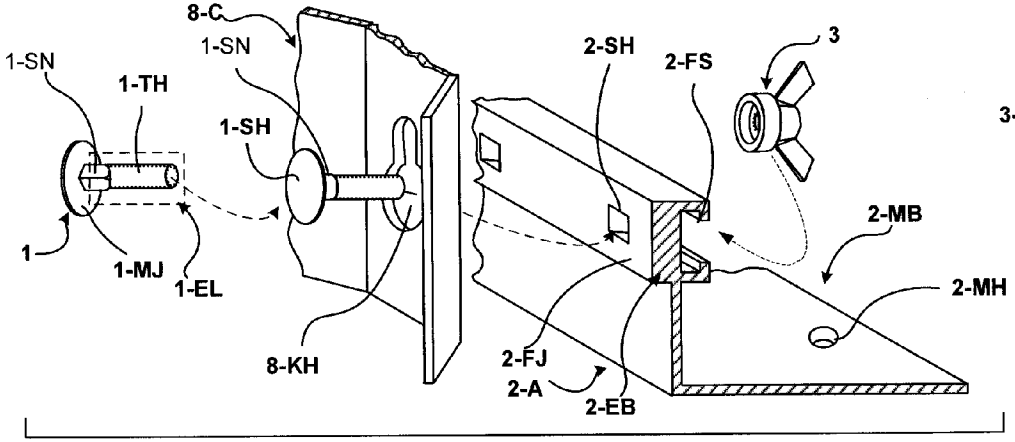
FIG. 1A is an exploded perspective view of a nut driven clamp fastener (2-NCF) assembly, with a fixed jaw member (2-A) in the form of angled "F" track, which is configured for mounting longwise spaced clamp fasteners (2-NCF).
Figure 1C:
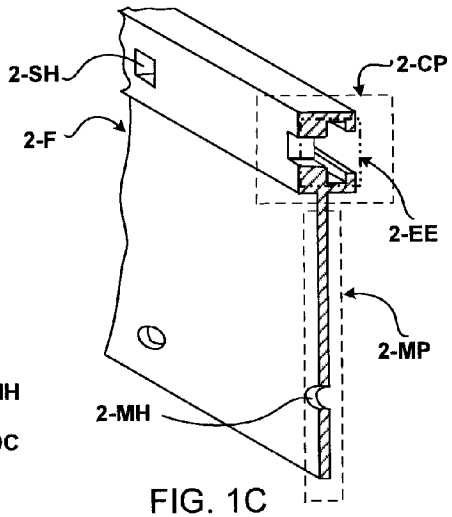
FIG. 1C is a perspective view of the fixed jaw member in the form of a flat "F" track, which is configured for mounting longwise spaced clamp fasteners (2-NCF).
Figure 1B:
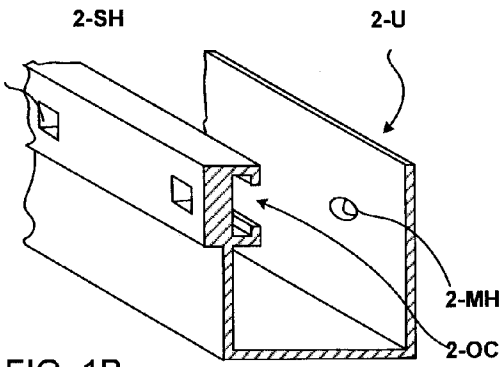
FIG. 1B is a perspective view of the fixed jaw member in the form of a U-shaped "F" track, which is configured for mounting longwise spaced clamp fasteners (2-NCF).

With reference to FIG. 1B, the hurricane protective system can be secured and released from the inside of the building wherein the under head part of the domed head (1-FJ) of the step-bolt (1) is armed with teeth-like serrations (1-SS) for biting into the shutter surface to resist vibration.

With regard to FIGS. 1 and 2, the hurricane protective system can be secured and released from the inside of the building wherein the connection of the engaging movable jaw (1-MJ) and sliding neck (1-SN) is inseparable and cannot be disassembled from outside of the building. The mounting part (2-MP) is positioned for mounting to the building in the area that is not accessible from outer side of the building during the time when the shield member (8) is secured over the building opening. The handle of the manipulator (3-WN, 3-WH, 3-KE) is limited to access only to a person in the building adjacent to the building opening. This provides both a burglar protection and egress from the building during emergency such as fire.

With regard to FIGS. 3A-C, the hurricane protective system can be secured and released from the inside of the building wherein the engaging movable jaw (1-MJ, 1-N) can be removably disengaged from the coupled together sliding neck (1-SN, 1-B) so that the movable jaw (1-MJ) can be disassembled from outside of the building for releasing the cover panel (8, 8-F). The progressive clamp fastener (2-PCF) is releasable by a person in the building adjacent to the building opening.

This arrangement provides both an outside assistance in escaping the building and initiated by an occupant egress from the building during emergency such as fire.

Figure 1G:
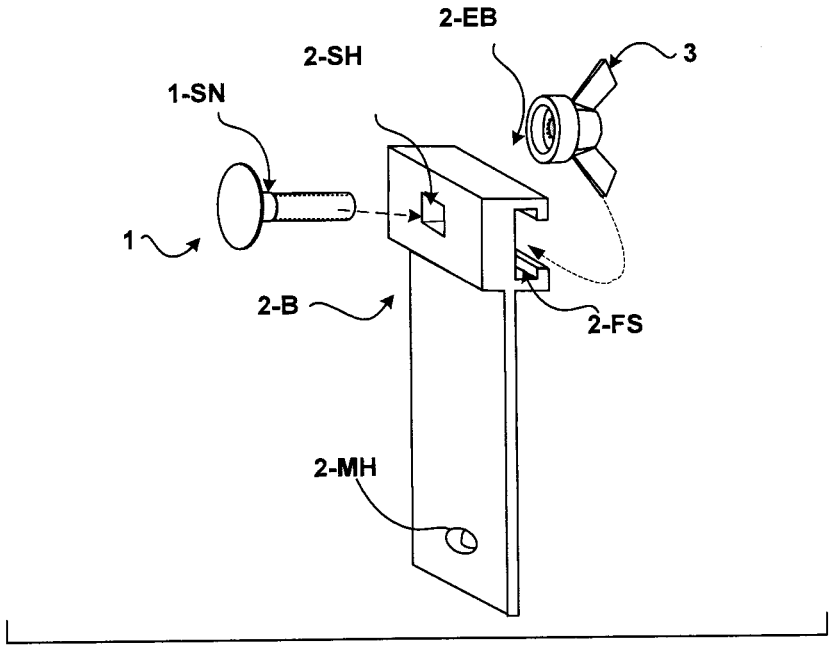
FIG. 1G is an exploded perspective view of a single nut driven clamp fastener (2-NCF), which is assembled using flat "F" track.
Figure 1H:
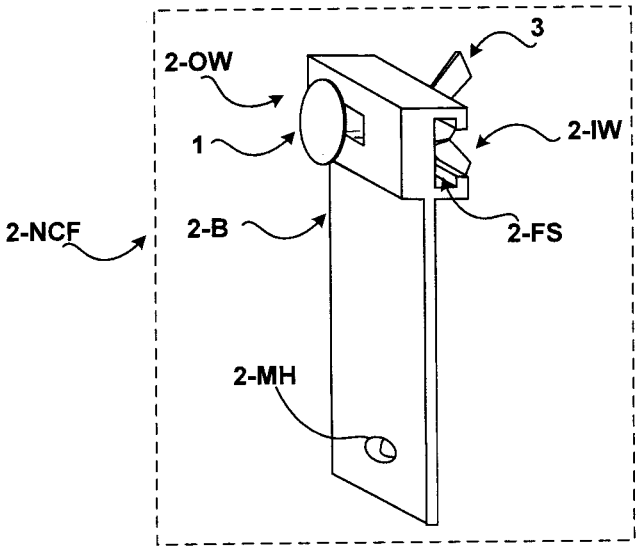
FIG. 1H is a perspective view of a single nut driven clamp fastener (2-NCF), which is assembled using flat "F" track.
Figure 2C:
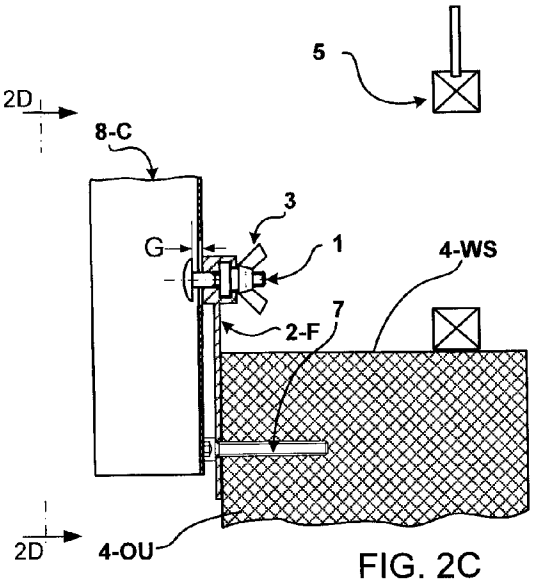
FIG. 2C is a cross-sectional view of a single nut driven clamp fastener (2-NCF) in the assembly with a corrugated panel (8-C) mounted over the window/door sill (4-WS), which is shown in a ready to be removed position.
Figure 2D:
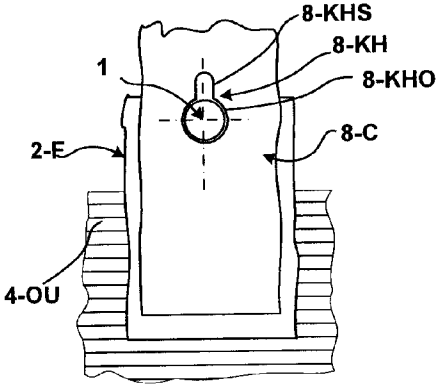
FIG. 2D shows View 2D of FIG. 2C.
Figure 2A:
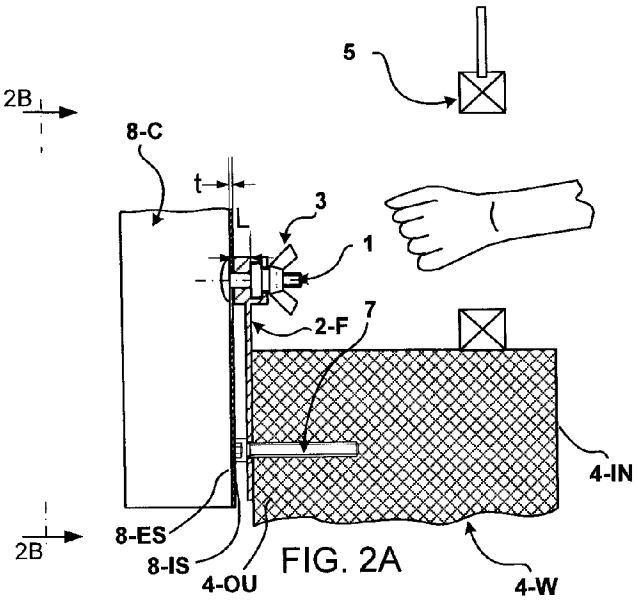
FIG. 2A is a cross-sectional view of a single nut driven clamp fastener (2-NCF) in the assembly with a corrugated panel (8-C) mounted over the window/door sill (4-WS), which is shown in a locked position.
Figure 2B:
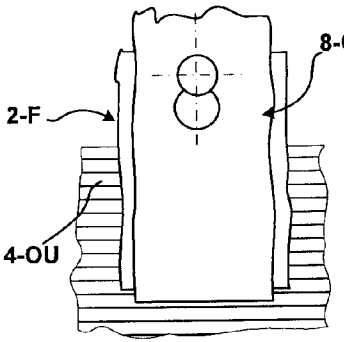
FIG. 2B shows View 2B of FIG. 2A.

With reference to FIGS. 1G-H, the hurricane protective system includes the fixed jaw member (2-A, 2-F, 2-U, 2-RB) configured for forming one aperture (2-SH, 2-TS) for engaging with one movable jaw member (1, 1-S,1-FW, 1-KE). This is in a combination with one manipulating member (3, 3-WH, 3-KE). Each of the clamp fasteners (2-NCF, 2-BCF) is mounted to the building individually.

With reference to FIG. 1, the hurricane protective system is for a building opening (4-O) that can be secured and released from the inside of the building. The fixed jaw member (2-A, 2-F, 2-U, 2-RB) is in a form of a rail, which is configured for mounting longwise spaced clamp fasteners (2-NCF, 2-BCF). The fixed jaw (2-FJ) is shared between more than one of the movable jaw members (1, 1-S,1-FW, 1-KE) for corresponding clamp fasteners (2-NCF, 2-BCF).

Figure 7C:
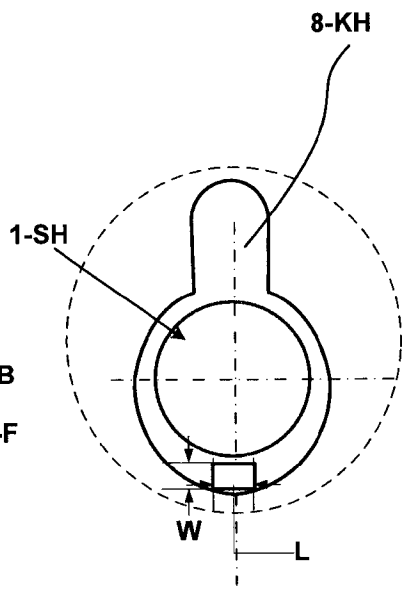
FIG. 7C is an enlarged view of a keyhole (8-KH) with positioned in the keyhole opening (8-KHO) a step bolt head (1-SH) and a stuck preventive ledge (2-TB) showing below the step bolt head (1-SH).
Figure 7B:
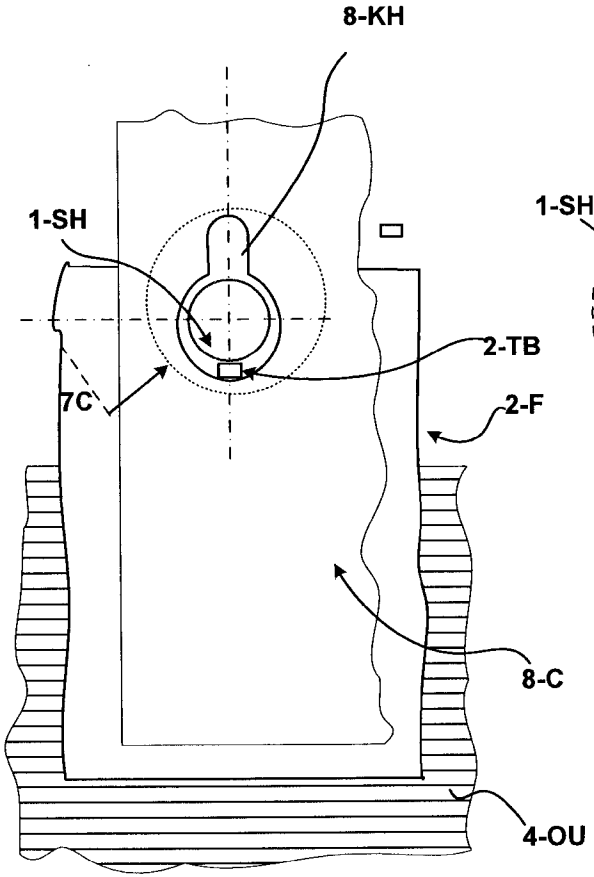
FIG. 7B shows a front view 7B of FIG. 7A.
Figure 7A:
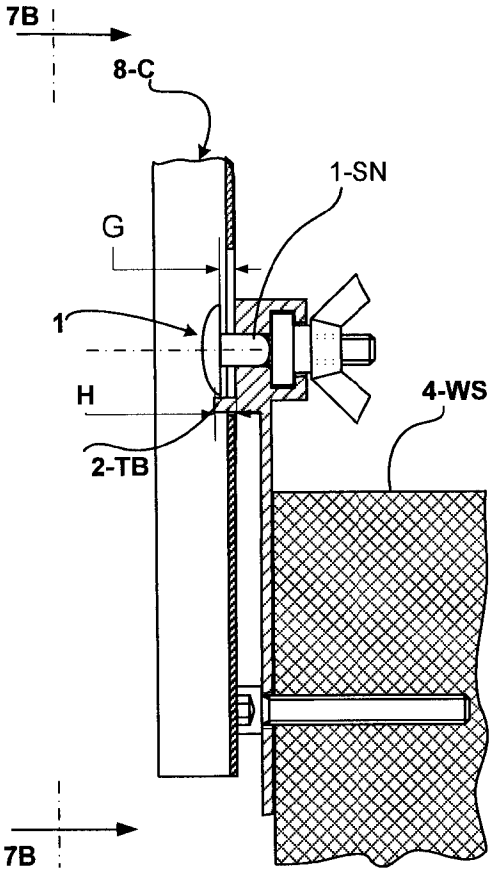
FIG. 7A is a cross-sectional view of a nut driven clamp fastener (2-NCF) in the assembly with a corrugated panel (8-C) mounted over the opening sill (4-WS), which is in the open position allowing to remove the panel (8-C), with a step bolt having a square neck (1) and a stuck preventive ledge (2-TB) positioned on the bottom portion of the "F" track rail below the step bolt head (1-SH), so that it prevents accidental stuck of a shutter panel.
Figure 8B:
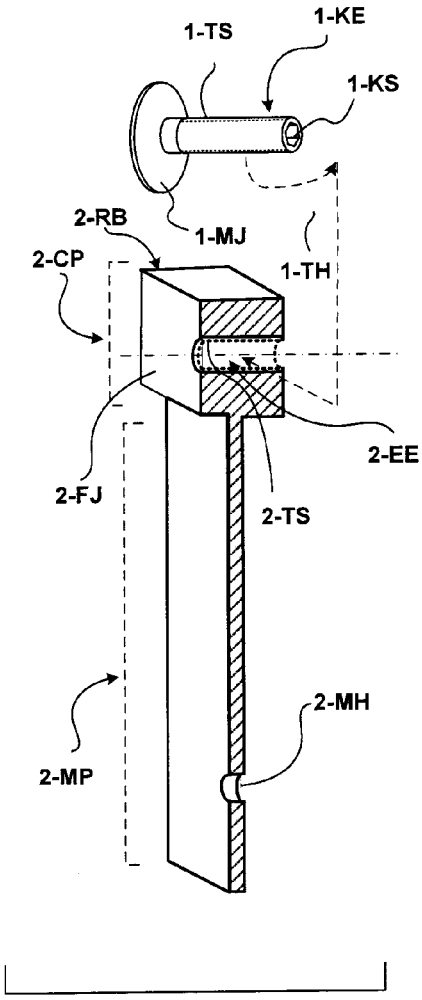
FIG. 8B is an exploded perspective view of a bolt driven clamp fastener assembly (2-BCF) having a key end socket head (1-KS), which is assembled using a rectangular bar (2-RB).
Figure 8A:
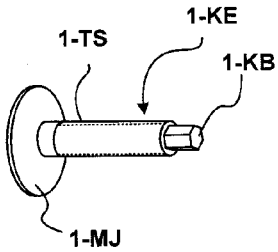
FIG. 8A is a perspective view of flange bolt with a key end (1-KE) having a key end bolt head (1-KB).
Figure 8C:
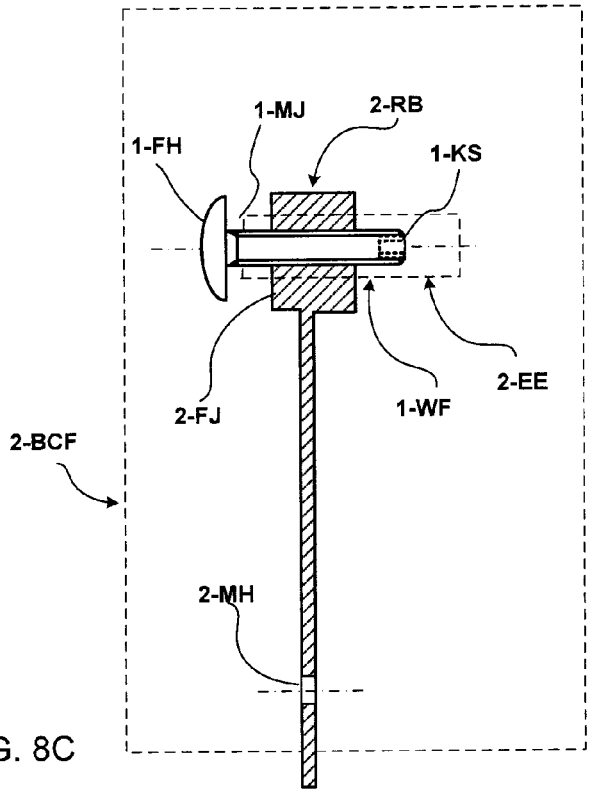
FIG. 8C is a cross-sectional view of a bolt driven clamp fastener assembly (2-BCF) having a key end socket head (1-KS).

With regard to FIGS. 7-7, the hurricane protective system further comprises a means for preventing accidental trapping (1-TR, 2-TB) the protective panel (8-C, 8-F) in the area surrounding the securable aperture between the fixed (2-FJ) and the movable (1-FJ) jaws at the stage of the removal of the protective panel (8-C, 8-F) from the building opening (4-O).

With regard to FIG. 6, the means for preventing accidental trapping (1-TR) is a part (1-TR) of the movable jaw member (1).

Further with regard to FIG. 6, the under head side has a nip (1-TR) along the shank at one side. The angle between the outer edge of the nip (1-TR) and flat under head side (1-FJ) is more than 90 degrees, more preferable in the range from 90 and 120 degrees and the length along the shank is not less than the maximum gap (G) between movable (1-MJ) and fixed (2-FJ) jaws.

This arrangement prevents accidental trapping of the panel between the fixed (2-MJ) and the movable (1-MJ) jaws at the stage of the removal the protective panel (8-C, 8-F) from the building opening (4-O).

With regard to FIG. 7, the means for preventing accidental trapping is a part (2-TB) of the fixed jaw member (2-A, 2-F, 2-U, 2-RB).

Further with regard to FIG. 7, the hurricane protective system further comprises a stuck preventive ledge (2-TB) in the area surrounding the flange bolt head (1-SH, 1-FH), with matching the preventive ledge width and length and keyhole opening (8-KHO) allowing fitting the panel in the gap between the movable jaw (1-MJ) and the fixed jaw (2-FJ), with positioning the stuck preventive ledge (2-TB) on the side opposite to the position of the key slot of the panel (8-KHS).

The height of the ledge (2-TB) is not less than the maximum gap (G) between the movable jaw (1-MJ) and the fixed jaw (2-FJ).

The width of stuck preventive ledge (2-TB) is less than the width of the keyhole slot (8-KHS) for loosely sliding along the keyhole slot (8-KHO).

In addition, the keyhole slot (8-KHS) has size sufficient to loosely pass through.

This arrangement provides for preventing accidental trapping the panel between the movable jaw (1-MJ) and the fixed jaw (2-FJ) at the stage of the removal the protective panel (8-C, 8-F) from the building opening (4-O).

Figure 9A:
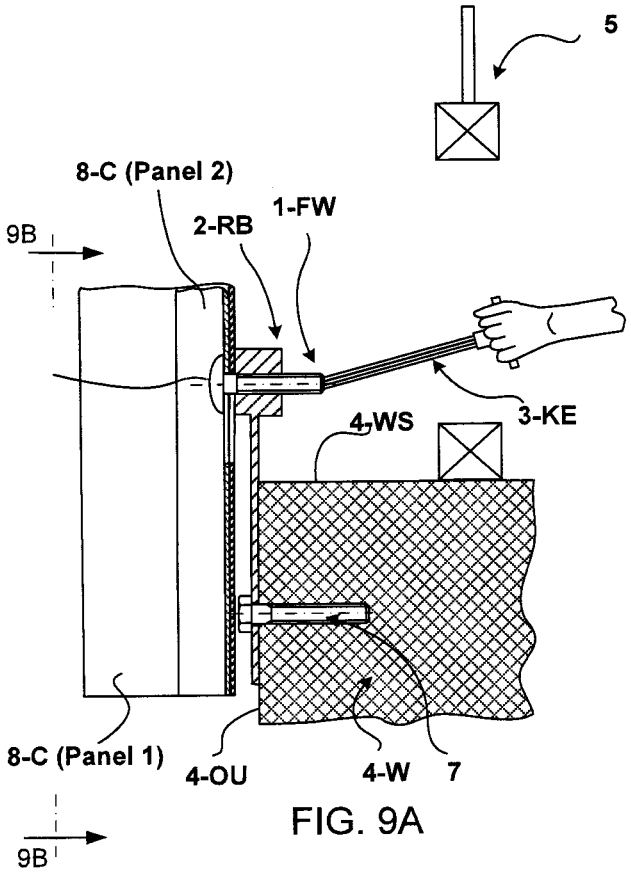
FIG. 9A is a cross-sectional view of the bolt driven clamp fastener (2-BCF) in a combination with a corrugated panel (8-C) mounted over the opening sill (4-WS), which are shown in a locked position, in which panel fastening and releasing is made a T handle Allen key (3-KE) inserted into a key end socket head (1-KS) of the flange bolt with a key end (1-KE).
Figure 10B:
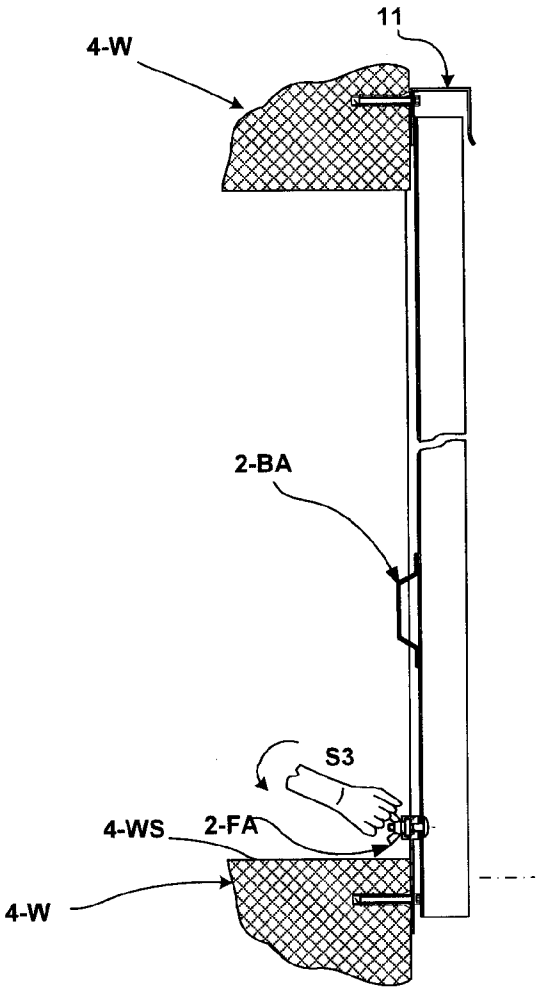
FIG. 10B is a cross-sectional view of the shutter system across a whole building opening (4-O), which is mounted with U-shaped rail (11) on the upper border of the opening (4O) and a flat "F" track (2-F) over the opening sill (4-WS), shown at the moment of fastening the last corrugated panel (8-C).
Figure 10A:
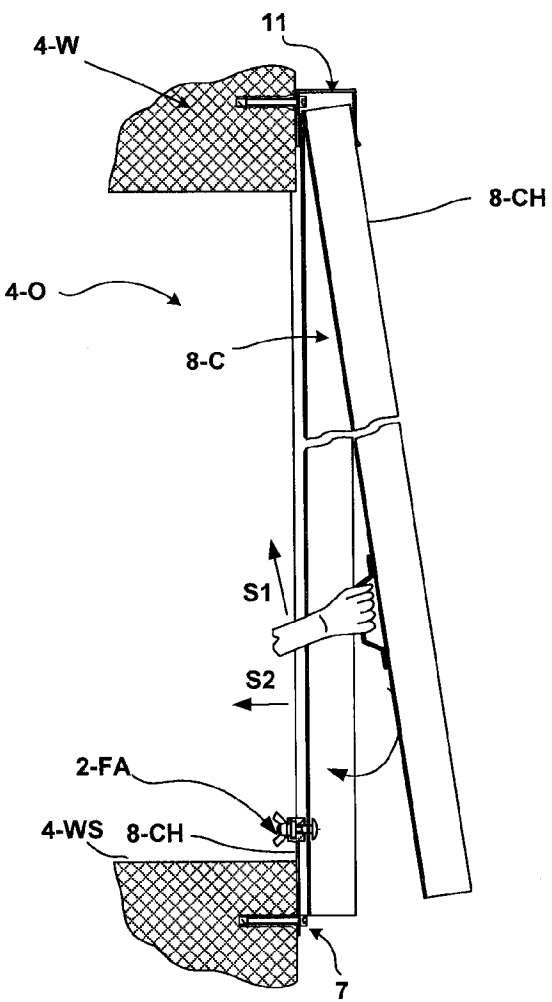
FIG. 10A is a cross-sectional view of the shutter system across a whole building opening (4-O), which is mounted with U-shaped rail (11) on the upper border of the opening (4O) and a flat "F" track (2-F) over the opening sill (4-WS), shown at the moment of positioning the last corrugated panel (8-C) with a handle (2-BA).

With regard to FIGS. 8, 9, the hurricane protective system the movable jaw member is selected from a group of bolts, more preferably of flange bolts having extending outward from the bolt head a skirt (1-MJ). The flange bolt has a thread (1-TS) for threaded engaging with the fixed jaw member (2-RB) and the end of the bolt has a means (1-KS, 1-KE) for engagement with the handle (3-KE).

The movable jaw (1-MJ) is the under head part of the flange bolt head.

The securable means of the shield member is an aperture (8-KH) in the shutter panel (8-C), which is selected from a group consisting of holes, preferably a keyhole slot (8-KH) having the round portion of the keyhole slot having size sufficient to loosely pass through the opening (8-KHO) of the head of the step-bolt. The width of the keyhole slot (8-KHS) is sufficient for loosely sliding the shank of the step-bolt along the slot. All the keyhole slots (8-KHS) in the panel have a major axis running generally parallel to the direction of extending from one border of the building opening toward the opposite the border.

The fixed jaw member (2-RB) is a railed extrusion selected from a group of strips and angles. The mounting part (2-MP) is located at a first end across and the clamping part (2-CP) is located at a second end across. The mounting part (2-MP) has at least one aperture (2-MH) for mounting to the building and the clamping part (2-CP) has at least one threaded aperture (2-TS) having a thread size the same as the thread size of the flange bolt (1-FW) for threaded engagement with the flange bolt (1-FW). The flange bolt (1-FW) is threaded into the aperture (2-TS) from the outward side (2-OW) of the clamping part (2-CP) and the means (1-KS, 1-KE) for engagement with the handle (3-KE) facing to inward side of the building opening (4-O).

The cover panel (8-C, 8-F) is positioned in the gap between the movable (1-MJ) and fixed (2-FJ) jaws, the accepted by the handle (3-KE) manually applied rotational movement is converted into the movement by screw of the movable jaw (1-MJ) for generating the clamping force for holding the panel (8-C, 8-F) in the fastened position.

In addition to the system as described above, the invention also includes a method of installation of a hurricane protective system, from the interior of a building over an opening (4-O). The opening has lower, upper, and side borders, in which vertically oriented sectional shutter panels (8) are employed, each of which has a cross-section shaped like a series of isosceles trapezoidal corrugations (8-C). Each of the sectional shutter panels have a keyhole apertures (8-KH). Each keyhole slot (8-KH) is aligned along the corrugations. The keyhole of one panel (8-KH) overlaps a keyhole of an adjacent panel (8-KH) in cooperation with elongated "F" track mounted along the lower border (4-WS) of the opening with installed clamp fasteners (2-PCF). The clamp fasteners are spaced accordingly spacing of the keyholes (8-KH) in the panel (8-C). Each of the clamp fasteners has a protruded out movable part (1-MJ) and positioned for providing a gap between the inner surface of step-bolt head (1-MJ) and outer surface of the "F" track (2-FJ). Such gap is sufficient to insert two overlapped panels (8-C) through their larger opening of keyholes (8-KHO). An elongated U-shaped track (11) is mounted to the upper border of the opening (4-O) and positioned with the open side of the U-shaped track facing down and having size sufficient to insert two overlapped corrugated panels (8-C).

The method steps comprise applying the adjacent panel sections (8-C) sequentially overlapping one over the other, starting from one side border of the opening (4-O) toward the opposite side border, firstly upwardly into the header (11), and thereafter placing each of the shutter's keyhole openings (8-KHO) over the step-bolt head (1-SH) of each clamp fastener (2-FA) mounted on the "F" track (2-F).

The next step is applying the last panel section (8-C) with a handler (2-BA) by holding the handler (2-BA) and manipulating the panel for overlapping, inserting in the header (11), and positioning over the step-bolt heads (1-SH) of two nearby clamp fasteners.

The next step is manually fastening each of the clamp fasteners (2-FA) from the interior of the building as the panel sections (8-C) are applied.

With reference to FIGS. 11, 12 the method features a system wherein at least one protective panel is employed, from the exterior of a building over an opening (4-O) having lower, upper, and side borders, in which at least one protective panel (8-F) is employed. The panel (8-F) is of slightly larger size than the size of an opening to be covered. The panel has keyhole apertures (8-KH) each formed by joined together a keyhole slot (8-KHS) and a keyhole opening (8-KHO).

Each of the keyhole slots (8-KHS) is aligned along the height of the opening so that the keyhole slot (8-KHS) is directed downward and the keyhole opening (8-KHO) is directed upward. Each border of the opening is equipped with an elongated "F" track mounted along of each border (4-WS) of the opening with installed nut driven clamp fasteners (2-PCF), which are spaced accordingly spacing of the keyholes apertures (8-KH) in the panel (8-F). Each of the clamp fasteners (2-PCF) has a protruded out movable part (1-MJ), which is a step-bolt head (1-SH) with its underhead side equipped with a nip (1-TR) along the step-bolt shank at one side. Each of the nips (1-SH) of the clamp fasteners (2-PCF) is aligned along the height of the opening (4-O) so that the nip (1-TR) is directed upward. Each step-bolt (1-T) is positioned to provide a gap (G) between the inner surface of step-bolt head (1-MJ) and outer surface of the "F" track (2-FJ), which is sufficient to insert a panel (8-F) through its larger opening of keyholes (8-KHO).

The method further includes the step of applying from the outside the panel (8-F) over the building opening (4-O) by passing through each of the keyhole openings (8-KHO), the step-bolt head (1-T) with the nip (1-TR) so that the panel (8-F) is positioned within the gap between the inner surface of step-bolt head (1-MJ) and outer surface of the "F" track (2-FJ).

The next step is lifting up the panel (8-F) allowing the shank of each step-bolt (1-T) to be slid along the keyhole slot (8-KHS) until the end of the keyhole slot (8-KHO) and holding the panel (8-F) in this position.

The next step is manually fastening each of the clamp fasteners (2-FA) from the interior of the building.

Thus provided is a burglar and a hurricane protection of the building opening.

In this manner, releasing each of the clamp fasteners (2-NCF) from the interior of the building will result in sliding down the panel (8-F) until it is brought up short against facing up stuck preventive nips (1-TR) and further falling down the panel outside from the building opening (4-O), thus providing egress from the building during emergency such as fire.

The present examples and descriptions should be considered as illustrative and not restrictive, and the invention is not to be limited to the details given herein but may be modified within the scope of the appended claims.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hurricane protective system for a building with a building opening that can be secured and released from inside the building comprising:

a shield member for fitting over the building opening;

a fixed jaw member; and at least one movable jaw member;

the shield member having an interior surface and an exterior surface, the shield member being accessible from inside the building, the shield member having at least one securable component for engaging with a clamp fastener for locking and releasing the securable component from the inside of the building and for holding the shield member in place and for removing the shield member from the building opening;

the fixed jaw member including a mounting part for mounting to the building and a clamping part, the clamping part having an inward side for positioning on an outward facing side of the building, the clamping part having an inward side facing inward of the building opening for engaging with and being in contact with the at least one securable component, an engaging element for engagement with the at least one movable jaw member coupled with a manipulating member, with the clamping part and the mounting part positioned apart one from the other so that the mounting part is fixed with a border of the opening and the clamping part is projecting from the border inward of the building opening and accessible from the inside of the building;

the at least one movable jaw member being on the inward facing side of the building for engaging with the securable component of the shield member and when in a holding position being in contact with an outward facing side of the shield member facing outward of the opening, an engaging link for functional engagement with both the fixed jaw member and the manipulating member in a clamped position so that the shield member is squeezed between the fixed jaw member outward side and the movable jaw member inward side;

the manipulating member positioned on a side of the clamp facing inward of the opening and being accessible from the inside of the building and functioning as a handle configured for accepting manually applied movement and an engaging pass for a functional engagement of the manipulating member with the fixed jaw member and the movable jaw member for generating inward pressure between the fixed jaw member and the movable jaw member for clamping;

wherein said clamp fastener is a nut driven clamp fastener, in which the manipulating member comprises joined together a nut for securing without the need for a tool, and a first holed engaging cylinder, and an engaging cylinder having an inner and an outer diameter and length, which are axially joined by a second holed neck cylinder having an inner and an outer diameter and length, with the inner diameter of the engaging cylinder and the neck cylinder being sufficient for penetration by a rod for engaging with threads of the nut and the outer diameter of the diameter of the first holed engaging cylinder being larger than the diameter of the second holed neck cylinder;

said at least one securable component of said shield member being an aperture in a shutter panel which is a keyhole slot having a round portion of said keyhole slot having size sufficient to loosely pass through the opening of the head of said step bolts and the width of the keyhole slot sufficient for loosely sliding the shank of said step-bolt along the slot, all said keyhole slots in said panel having a major axis running generally parallel to a direction of extending from one border of said building opening toward an opposite border, said fixed jaw member being F tracks having F channels extended along the F track and located in the clamping part, the F channel having crossed inner width and length and connected with a narrower outlet open channel having crossed width and length, which is symmetrical relatively to a wider F channel, said mounting part being located across the track on the side opposite to said F channel, said F channel of said F track being located on the side facing inward the opening, said fixed jaw being on the side facing outward of said building opening, said F channel being accompanied by a narrower outlet open channel sufficient for inserting and sliding said engaging and neck cylinders of said manipulating member, a slidable aperture protruding symmetrically in relation to both said and outlet channels connecting with the side facing outward of said building opening, said fixed jaw side, said slidable aperture is frictionally coupled with the square shank of said step bolt, whereby, when assembling said progressive clamp fastener, providing slidable insertion and rotational movement of said engaging cylinder of said manipulating member in said F channel and axial threaded engagement of the threaded part of said manipulating member, which is inserted into said slidable aperture from said outward side to said inward side of said engaging element, with said threaded part of said step-bolt, thus providing applied rotational movement by said handle into a progressive movement of said movable jaw for generating a clamping force applied to said panel, when said panel is positioned in the gap between said movable jaw and said fixed jaw, resulting in holding said panel in the fastened position.

2. The hurricane protective system for a building opening that can be secured and released from the inside of said building of claim 1 wherein the domed head of said step-bolt has an under head part armed with teeth-like serrations for biting into the shutter surface to resist vibration.

3. The hurricane protective system for a building opening that can be secured and released from the inside of said building of claim 1 wherein the connection of said engaging movable jaw and sliding neck is inseparable and cannot be disassembled from outside of the building, a mounting part positioned for mounting to said building in the area that is not accessible from the outside of said building during a time when the shield member is secured over said building opening, and said handle of said manipulator is limited to access only to a person in said building adjacent to said building opening;

whereby providing both a burglar protection and egress from the building during an emergency such as fire.

4. The system as set forth in claim 1 wherein the movable jaw member is selected from a group of bolts having an enlarged domed head and a non-round shank under the head and including step-bolts having a square shank at an under head part of said head, said square shank under the head constituting a sliding neck, and said movable jaw member is a threaded part of the step bolt which has the same size thread as the size of a thread of a nut of the manipulating member.

* * * * *